US006173586B1

(12) United States Patent
Bonaquist et al.

(10) Patent No.: US 6,173,586 B1
(45) Date of Patent: Jan. 16, 2001

(54) CRYOGENIC RECTIFICATION SYSTEM FOR PRODUCING VERY HIGH PURITY OXYGEN

(75) Inventors: Dante Patrick Bonaquist, Grand Island; John Fredric Billingham, Getzville, both of NY (US)

(73) Assignee: Praxair Technology, Inc., Danbury, CT (US)

( * ) Notice: Under 35 U.S.C. 154(b), the term of this patent shall be extended for 0 days.

(21) Appl. No.: 09/386,276

(22) Filed: Aug. 31, 1999

(51) Int. Cl.[7] ..... F25J 1/00

(52) U.S. Cl. ..... 62/643; 62/905; 62/646

(58) Field of Search ..... 62/643, 646, 655, 62/905

(56) References Cited

U.S. PATENT DOCUMENTS

| | | | | |
|---|---|---|---|---|
| 4,091,633 | * | 5/1978 | Linde | 62/643 |
| 4,615,716 | | 10/1986 | Cormier et al. | 62/24 |
| 4,838,913 | | 6/1989 | Victor et al. | 62/22 |
| 5,049,173 | | 9/1991 | Cormier, Sr. et al. | 62/24 |
| 5,339,648 | | 8/1994 | Lockett et al. | 62/24 |
| 5,590,543 | | 1/1997 | Agrawal et al. | 62/643 |
| 5,881,570 | | 3/1999 | Drnevich et al. | 62/646 |
| 5,918,482 | | 7/1999 | Potempa | 62/646 |
| 5,956,972 | * | 9/1999 | Naumovitz | 62/643 |

* cited by examiner

*Primary Examiner*—Ronald Capossela
(74) *Attorney, Agent, or Firm*—Stanley Ktorides

(57) ABSTRACT

A cryogenic air separation system for producing very high purity oxygen employing a lower pressure column having a volume in its lower portion set off by a diaphragm, and an upgrader column communicating with the lower pressure column in a defined manner relative to the diaphragm.

10 Claims, 1 Drawing Sheet

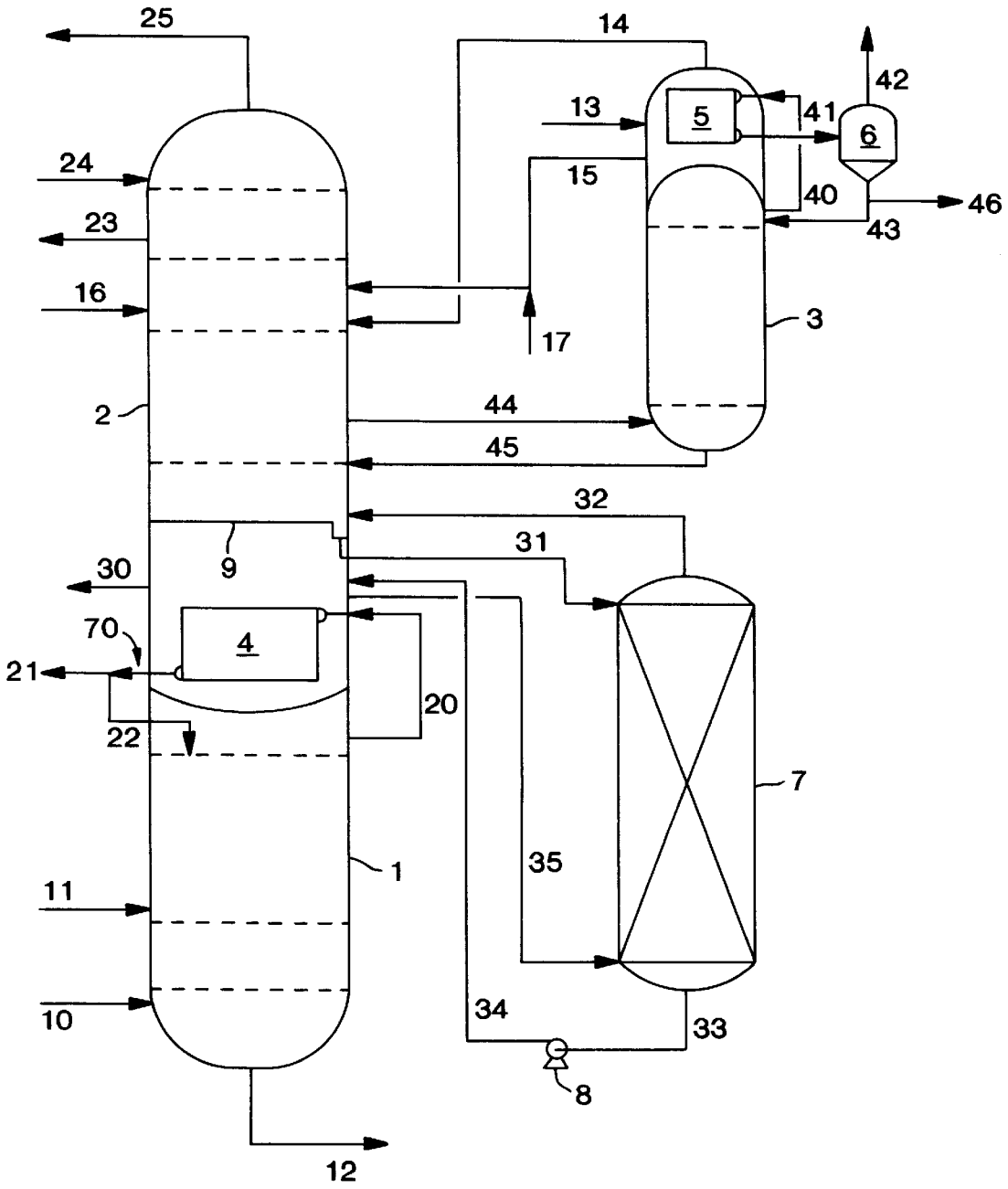
25
14
42
13
5
41
6
24
15
40
46
23
43
16
17
3
2
44
45
32
31
9
30
70
4
21
20
22
7
35
1
11
10
34
33
8
12

CRYOGENIC RECTIFICATION SYSTEM FOR PRODUCING VERY HIGH PURITY OXYGEN

TECHNICAL FIELD

This invention relates generally to the cryogenic rectification of feed air and, more particularly, to the cryogenic rectification of feed air to produce oxygen.

BACKGROUND ART

In the cryogenic rectification of feed air into nitrogen and oxygen products, the oxygen is typically produced at a purity of about 99.5 mole percent. Because of the relative volatilities of the components of air, the argon in the feed air tends to concentrate with the oxygen rather than with the nitrogen. Accordingly, the remainder of the typical oxygen product stream from a conventional cryogenic air separation process is comprised primarily of argon.

For most uses, the presence of this small amount of argon in the oxygen stream is not a problem. However, in some situations, such as in the use of oxygen in the production of chemicals such as ethylene oxide, the argon, owing to its inertness, undergoes a buildup within the chemical reactor requiring a periodic venting of the reactor so as to avoid retarding the production reaction. This periodic venting causes a loss of valuable products.

The problem of production reaction burden due to argon buildup can be addressed by increasing the purity of the oxygen input to the reactor, and systems for producing oxygen of higher than conventional purity are known. However, such systems generally can produce only relatively small quantities of elevated purity oxygen. Moreover, such systems are generally not readily adaptable to existing cryogenic rectification systems designed to produce oxygen of conventional purity.

Accordingly, it is an object of this invention to provide an improved cryogenic rectification system for the production of very high purity oxygen.

It is another object of this invention to provide an improved cryogenic rectification system for the production of very high purity oxygen which can be easily retrofitted to existing systems designed to produce oxygen of conventional purity.

SUMMARY OF THE INVENTION

The above and other objects, which will become apparent to those skilled in the art upon a reading of this disclosure, are attained by the present invention, one aspect of which is:

A method for producing very high purity oxygen by the cryogenic rectification of feed air comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column having a diaphragm in its lower portion, and producing oxygen-rich liquid by cryogenic rectification within the lower pressure column;

(C) passing oxygen-rich liquid from the lower pressure column above the diaphragm into an upgrader column, and producing oxygen-richer liquid by cryogenic rectification within the upgrader column;

(D) passing oxygen-richer liquid from the lower portion of the upgrader column into the lower pressure column below the diaphragm, and at least partially vaporizing the oxygen-richer liquid to produce oxygen-richer fluid; and (E) recovering oxygen—richer fluid from the lower pressure column as product very high purity oxygen.

Another aspect of the invention is:

Apparatus for producing very high purity oxygen by the cryogenic rectification of feed air comprising:

(A) a higher pressure column and means for passing feed air into the higher pressure column;

(B) a lower pressure column, means for passing fluid from the higher pressure column into the lower pressure column, and a diaphragm in the lower portion of the lower pressure column;

(C) an upgrader column, means for passing liquid from the lower pressure column above the diaphragm to the upper portion of the upgrader column, and means for passing vapor from the lower pressure column below the diaphragm to the lower portion of the upgrader column;

(D) means for passing vapor from the upper portion of the upgrader column to the lower pressure column above the diaphragm, and means for passing liquid from the lower portion of the upgrader column to the lower pressure column below the diaphragm; and (E) means for recovering very high purity oxygen from the lower pressure column below the diaphragm.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "very high purity oxygen" means a fluid having an oxygen concentration of at least 99.9 mole percent.

As used herein, the term "diaphragm" means a device which prevents, or substantially prevents, the flow of material across it

BRIEF DESCRIPTION OF THE DRAWING

The sole FIGURE is a simplified schematic representation of one preferred embodiment of the cryogenic rectification system of this invention.

DETAILED DESCRIPTION

The invention will be described in greater detail with reference to the Drawing.

Referring now to the FIGURE, feed air, which has been cleaned of high boiling impurities such as water vapor, carbon dioxide and hydrocarbons, and which has been cooled to about its dew point, is passed into higher pressure column 1, which is part of a double column which also includes lower pressure column 2. In the embodiment of the invention illustrated in the FIGURE, the feed is provided into higher pressure column 1 as vapor stream 10 and optionally as liquid or mixed phase stream 11 which is passed into column 1 between 1 to 10 equilibrium stages above where stream 10 is passed into column 1. Optionally, a portion of the feed air may be turboexpanded to generate refrigeration and then passed into lower pressure column 2 as illustrated by stream 16.

Higher pressure column 1 is operating at a pressure generally within the range of from 75 to 125 pounds per square inch absolute (psia). Within higher pressure column 1 the feed air is separated by cryogenic rectification into nitrogen-enriched fluid and oxygen-enriched fluid. Nitrogen-enriched fluid is withdrawn from the upper portion of higher pressure column 1 as vapor stream 20 and passed into main condenser 4 wherein it is condensed by indirect heat exchange with oxygen-richer liquid as will be more fully described below. Resulting nitrogen-enriched liquid is withdrawn from main condenser 4 as stream 70. A first portion 22 of stream 70 is returned to higher pressure column 1 as reflux, and a second portion 21 is subcooled (not shown) and then passed into the upper portion of lower pressure column 2 in stream 24 as reflux.

Oxygen-enriched fluid is withdrawn from the lower portion of higher pressure column 1 and passed into the lower pressure column. The embodiment of the invention illustrated in the FIGURE is a preferred embodiment employing an argon sidearm column with a top condenser. In accord with this embodiment, oxygen-enriched fluid is withdrawn from higher pressure column 1 as liquid stream 12 and a portion subcooled (not shown) and then passed to argon column top condenser 5 as stream 13. Here the oxygen-enriched liquid is partially vaporized, with resulting oxygen-enriched vapor passed into lower pressure column 2 as stream 14 and remaining oxygen-enriched liquid passed into lower pressure column 2 as stream 15. The remaining portion of oxygen-enriched liquid 12 is also passed into lower presser column 2 as stream 17, either separately, or as shown in the FIGURE, in combination with stream 15.

Lower pressure column 2 is operating at a pressure less than that of higher pressure column 1 and generally within the range of from 15 to 25 psia. Within lower pressure column 2 the various feeds into that column are separated by cryogenic rectification into nitrogen-rich vapor and oxygen-rich liquid. Nitrogen-rich vapor is withdrawn from the upper portion of lower pressure column 2 as stream 25 and removed from the system. Nitrogen-rich vapor stream 25 may be recovered in whole or in part as product nitrogen having a nitrogen concentration of at least 99.9 mole percent. For product purity control purposes a waste stream 23 is withdrawn from the upper portion of lower pressure column 2 below the withdrawal level of stream 25, and removed from the system.

Lower pressure column 2 contains a diaphragm 9 in the lower portion but above main condenser 4, and oxygen-rich liquid collects on the upper surface of diaphragm 9. The diaphragm may be immediately above the main condenser or there may be one or more equilibrium stages between the main condenser and the diaphragm. Oxygen-rich liquid from above diaphragm 9, either, as shown in the FIGURE, from the liquid which collects on diaphragm 9, or from a tray or packed bed above diaphragm 9, is passed from lower pressure column 2 into the upper portion of upgrader column 7. In the embodiment illustrated in the FIGURE, this passage of oxygen-rich liquid is illustrated by stream 31. Vapor from the volume of lower pressure column 2 below diaphragm 9 is passed in stream 35 into the lower portion of upgrader column 7.

Upgrader column 7 is operating at a pressure generally within the range of from 16 to 26 psia. Within upgrader column 7 the fluids passed into that column are separated by cryogenic rectification into nitrogen-richer vapor and oxygen-richer liquid. Nitrogen-richer vapor is withdrawn from the upper portion of upgrader column 7 in stream 32 and passed into lower pressure column 2 above diaphragm 9. Oxygen-richer liquid is withdrawn from the lower portion of upgrader column 7 in stream 33, passed through pump 8, and pumped as stream 34 into lower pressure column 2 below diaphragm 9. The oxygen-richer liquid is at least partially vaporized by indirect heat exchange with the aforesaid condensing nitrogen-enriched vapor in main condenser 4, and a portion of the resulting oxygen-richer vapor is passed into the lower portion of upgrader column 7 through line 35 as was previously described. Another portion of the oxygen-richer vapor is withdrawn from lower pressure column 2 below diaphragm 9 in stream 30 and recovered as product very high purity oxygen. If desired some of the oxygen-richer liquid may be recovered as liquid very high purity oxygen either directly from upgrader column 7 or from lower pressure column 2 below diaphragm 9.

As mentioned, the embodiment of the invention illustrated in the FIGURE is a preferred embodiment wherein an argon sidearm column is employed to produce product argon. Referring back now to the FIGURE, a stream comprising argon and oxygen is withdrawn from lower pressure column 2 above diaphragm 9 in stream 44 either immediately above diaphragm 9, i.e. with no equilibrium stages between the withdrawal level of stream 44 and diaphragm 9, or with one or more equilibrium stages between the withdrawal level of stream 44 and diaphragm 9. Stream 44 is passed into argon column 3 wherein it is separated by cryogenic rectification into argon-richer vapor and remaining oxygen-containing liquid. The remaining oxygen-containing liquid is passed in stream 45 from the lower portion of argon column 3, which is operating at a pressure generally within the range of from 15 to 25 psia, into lower pressure column 2 at a level above diaphragm 9, typically from 20 to 50 equilibrium stages above diaphragm 9.

Argon-richer vapor is passed in line 40 from argon column 3 into top condenser 5 wherein it is partially condensed by indirect heat exchange with the aforesaid partially vaporizing oxygen-enriched liquid. Resulting two phase argon-richer fluid is passed in stream 41 to phase separator 6 wherein it is gravity separated into argon-richer vapor, which is recovered as argon product stream 42 having an argon concentration of from 90 to about 100 mole percent, and into argon-richer liquid which is returned to argon column 3 in stream 43 as reflux. If desired, a portion 46 of stream 43 may be recovered as liquid argon product.

A particular advantage of this invention is that it may be readily retrofitted to an existing conventional cryogenic air separation so as to produce very high purity oxygen. For example, upgrader column 7, pump 8 and the majority of lines 31, 32, 33, 34 and 35 may be assembled ahead of time and packaged in a manner that permits them to be installed along side of the existing plant containing lower pressure column 2 while the existing plant is still in operation. Once the new elements are in place, the existing plant is shut down. Diaphragm 9 is then installed in the existing lower pressure column 2 and, at the same time, the connections of lines 31, 32, 34 and 35 to the existing lower pressure column 2 are made.

Although the invention has been described in detail with reference to a particularly preferred embodiment, those skilled in the art will recognize that there are other embodiments of the invention within the spirit and the scope of the claims. For example, the argon column and the upgrader column could be combined or otherwise integrated. In such a case the remaining oxygen-containing liquid, represented by stream 45 in the FIGURE, would flow into the upper portion of the upgrader column. Also some of the vapor from the upper portion of the upgrader column could flow into the lower portion of the argon column.

What is claimed is:

1. A method for producing very high purity oxygen by the cryogenic rectification of feed air comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column having a diaphragm in its lower portion, and producing oxygen-rich liquid by cryogenic rectification within the lower pressure column;

(C) passing oxygen-rich liquid from the lower pressure column above the diaphragm into an upgrader column, and producing oxygen-richer liquid by cryogenic rectification within the upgrader column;

(D) passing oxygen-richer liquid from the lower portion of the upgrader column into the lower pressure column below the diaphragm, and at least partially vaporizing the oxygen-richer liquid to produce oxygen-richer fluid; and (E) recovering oxygen-richer fluid from the lower pressure column as product very high purity oxygen.

2. The method of claim 1 further comprising passing oxygen-richer fluid as vapor from the lower pressure column below the diaphragm into the lower portion of the upgrader column.

3. The method of claim 1 further comprising producing nitrogen-richer vapor in the upgrader column and passing nitrogen-richer vapor from the upper portion of the upgrader column into the lower pressure column above the diaphragm.

4. The method of claim 1 further comprising passing an argon-containing fluid from the lower pressure column above the diaphragm into an argon column and separating the argon-containing fluid by cryogenic rectification within the argon column to produce argon-richer fluid for recovery as argon product.

5. The method of claim 4 further comprising passing liquid from the lower portion of the argon column into the lower pressure column above the diaphragm.

6. Apparatus for producing very high purity oxygen by the cryogenic rectification of feed air comprising:

(A) a higher pressure column and means for passing feed air into the higher pressure column;

(B) a lower pressure column, means for passing fluid from the higher pressure column into the lower pressure column, and a diaphragm in the lower portion of the lower pressure column;

(C) an upgrader column, means for passing liquid from the lower pressure column above the diaphragm to the upper portion of the upgrader column, and means for passing vapor from the lower pressure column below the diaphragm to the lower portion of the upgrader column;

(D) means for passing vapor from the upper portion of the upgrader column to the lower pressure column above the diaphragm, and means for passing liquid from the lower portion of the upgrader column to the lower pressure column below the diaphragm; and (E) means for recovering very high purity oxygen from the lower pressure column below the diaphragm.

7. The apparatus of claim 6 further comprising an argon column with a top condenser, means for passing fluid from the lower pressure column above the diaphragm to the argon column, and means for recovering product argon from the upper portion of the argon column.

8. The apparatus of claim 7 further comprising means for passing fluid from the lower portion of the argon column into the lower pressure column above the diaphragm.

9. The apparatus of claim 6 wherein the lower pressure column includes a main condenser below the diaphragm and there are no equilibrium stages between the main condenser and the diaphragm.

10. The apparatus of claim 6 wherein the lower pressure column includes a main condenser below the diaphragm and there are one or more equilibrium stages between the main condenser and the diaphragm.

* * * * *